United States Patent [19]

Frommherz

[11] Patent Number: 4,468,006

[45] Date of Patent: Aug. 28, 1984

[54] CONTINUOUS WINCH

[75] Inventor: Egon Frommherz, Steinen, Fed. Rep. of Germany

[73] Assignee: Rotzler GmbH and Co. Spezialfabrik für Seilwinden und Hebezeuge, Steinen, Fed. Rep. of Germany

[21] Appl. No.: 421,955

[22] Filed: Sep. 23, 1982

[30] Foreign Application Priority Data

Oct. 24, 1981 [DE] Fed. Rep. of Germany ..... 3142329

[51] Int. Cl.[3] ..... B66D 3/00; B66D 1/26

[52] U.S. Cl. ..... 254/389; 242/157 R; 254/278; 254/382

[58] Field of Search ..... 254/294, 278, 382, 389; 226/196; 242/83, 157 C, 157 R

[56] References Cited

U.S. PATENT DOCUMENTS

| | | | |
|---|---|---|---|
| 420,509 | 2/1890 | Griswold | 226/196 X |
| 3,052,425 | 9/1962 | Reed et al. | 242/157 R |
| 3,776,519 | 12/1973 | Hamilton | 254/382 X |
| 3,886,888 | 6/1975 | Parsons | 254/389 X |
| 4,225,119 | 9/1980 | Frommherz | 254/294 |

*Primary Examiner*—Stuart S. Levy
*Assistant Examiner*—Katherine Jaekel
*Attorney, Agent, or Firm*—Becker & Becker, Inc.

[57] ABSTRACT

A continuous cable winch having at least one cable drum arranged within the winch frame, and a cable storage drum located externally of the frame for receiving a non-loaded cable section which is disposed with play in a guide which surrounds the cable and is located in the region between the winch frame and the cable storage drum. The ends of the guide are respectively secured on the winch frame and on the cable storage drum. The guide is flexible, and has radially open portions over its periphery. The guide may be a helical spring, the coils or windings of which are spaced from one another.

7 Claims, 3 Drawing Figures

CONTINUOUS WINCH

The present invention relates to a continuous cable winch having at least one rope or cable drum, or hoisting drum, arranged within the winch frame or support and a cable storage drum located externally of the frame for receiving or taking up a non-loaded cable section; this cable section is disposed with play in a guide which surrounds the rope or cable and is located in the region between the winch frame and the cable storage drum; the ends of the guide are respectively secured on the winch frame and on the cable storage drum.

A continuous winch of this general type is disclosed for instance in U.S. Pat. No. 4,225,119 Frommherz dated Sept. 30, 1980 and belonging to the assignee of the present invention. As a guide for the cable section located between the frame of the continuous winch and the cable storage drum, a pipe or tube which surrounds the cable is provided. Aside from the fact that the pipe or tube must be suitably bent to fit properly prior to assembly, such a guide proves to be problematical in practice. Since the cable is often very dirty, the tube becomes clogged with dirt, making it difficult for the cable to move therein. Furthermore, a relatively great amount of dirt reaches the cable storage drum, so that the cable sticks together in the drum, and can only be removed therefrom by expending a lot of energy.

It is an object of the present invention to provide a guide which avoids a clogging of the cable with dirt, and which also extensively prevents the entry of dirt into the cable drum.

This object, and other objects and advantages of the present invention, will appear more clearly from the following specification in connection with the accompanying drawings, in which.

The continuous winch of the present invention is characterized primarily in that the guide is flexible and has radially open portions over its periphery.

Due to the radially open portions of the guide, one is assured that dirt loosened from the cable can drop out of the guide, as a result of which a clogging of the guide is avoided. Due to the resilient construction of the guide, the latter is caused to vibrate when the cable passes therethrough, whereby a cleaning effect occurs. The vibrating guide additionally strikes against the cable which passes therethrough, so that dirt still adhering thereto is loosened or knocked-off and drops out of the guide. The cable entering the cable storage drum is thus extensively free of dirt, so that the cable does not stick together in the drum.

In one advantageous embodiment, a helical or spiral spring is provided as a guide, the windings or coils of which are spaced from one another. Since the helical spring can be adapted to any curved configuration without further measures having to be taken, the manufacture and assembly of the guide in accordance with the present invention is also considerably simpler than with the previously known cable winches.

According to further embodiments of the present invention, an exit guide-piece may be arranged on the winch frame in such a way that the cable exits the winch frame at an exit angle of approximately 15°. An inlet guide-piece may be arranged on the cable storage drum in such a manner that the cable enters the cable storage drum at an entry angle of approximately 30°. One of the two ends of the helical spring is respectively fastened to each guide-piece. The drum for storing the cable may be mounted on a supporting arm of the winch frame.

The axis of rotation of the cable storage drum may be approximately perpendicular to the common plane of the axes of rotation of the two cable drums, which are mounted in the winch frame.

Figure 1:
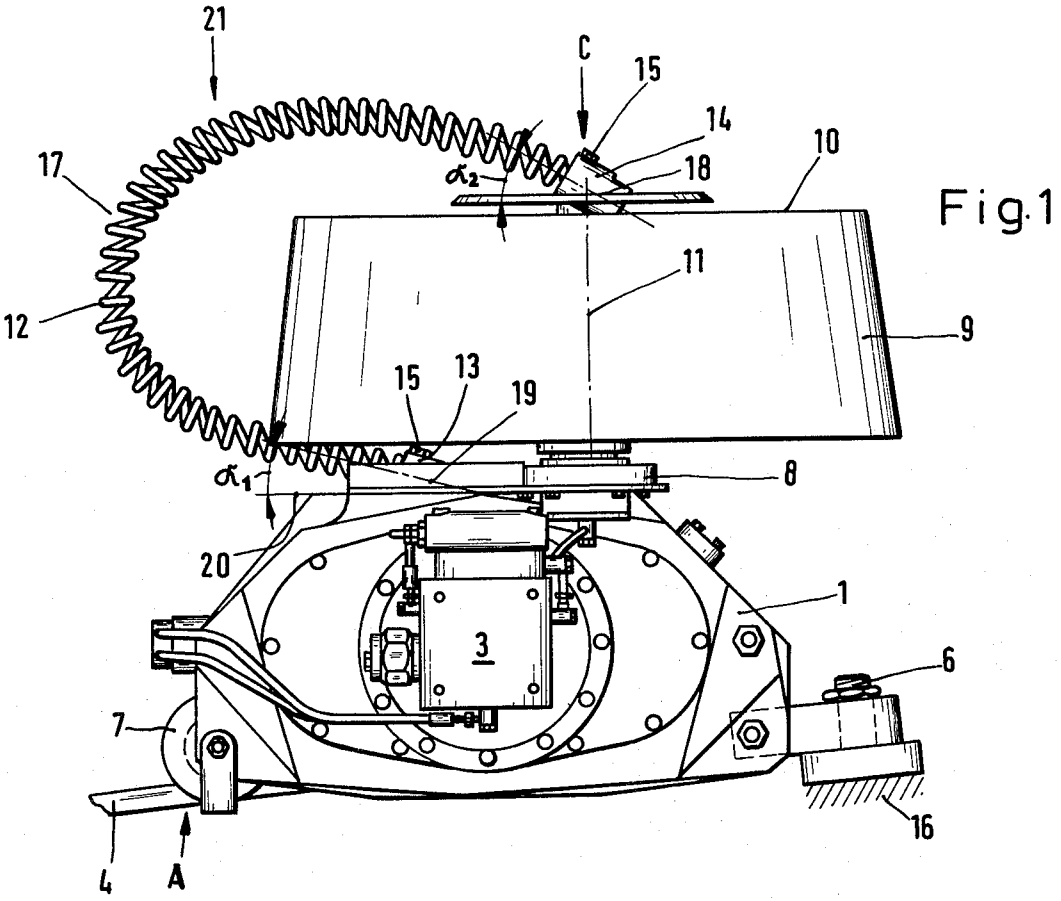
FIG. 1 is a side view of an inventive guide, which is located between the frame or support of the continuous winch and the cable storage drum.
Figure 2:
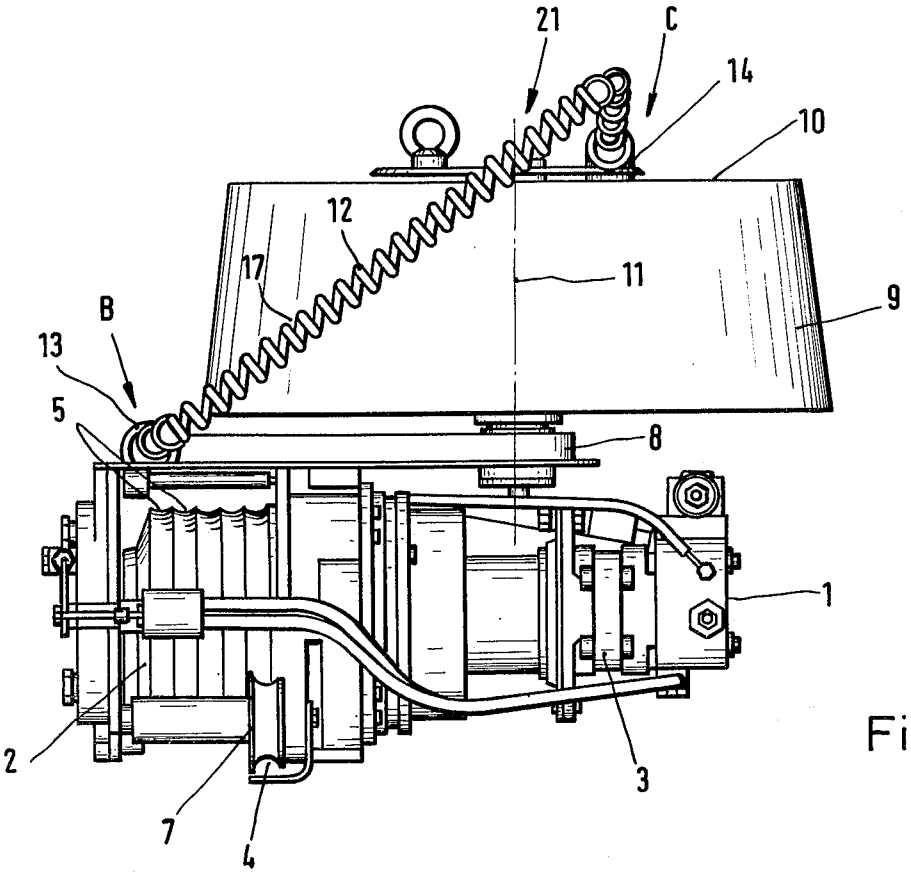
FIG. 2 is a front view of the arrangement according to FIG. 1.
Figure 3:
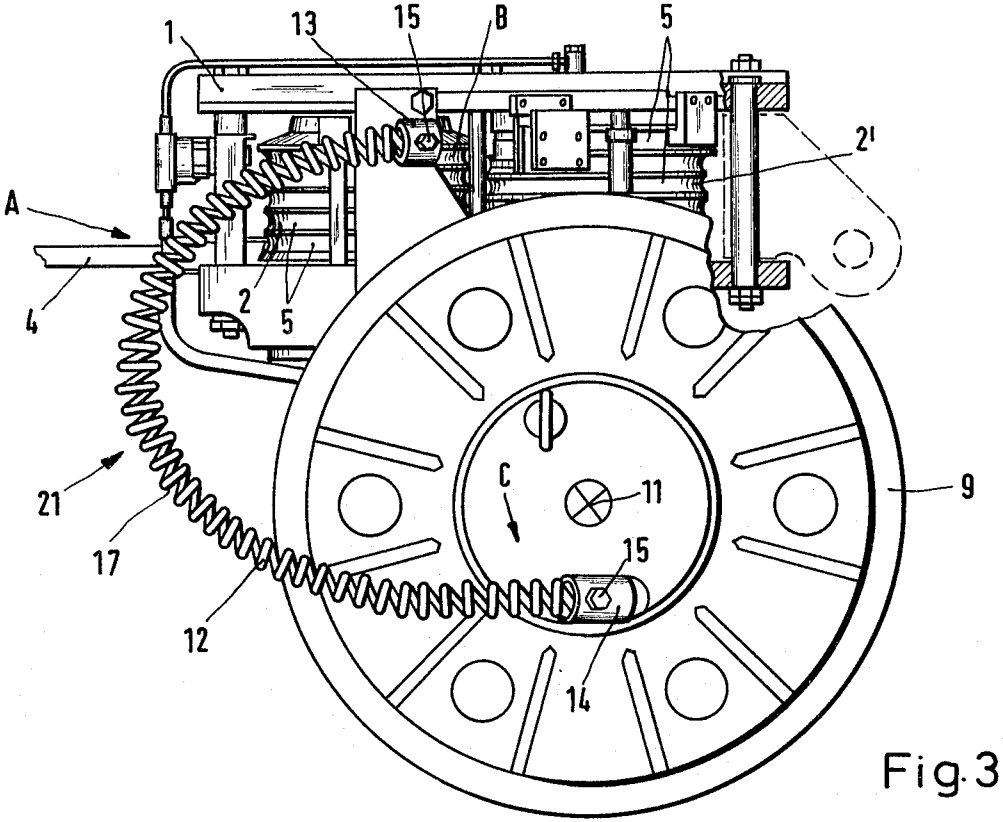
FIG. 3 is a plan view of the arrangement according to FIG. 1.

Referring now to the drawings in detail, the continuous winch has a frame or support 1 in which two rope or cable drums 2 and 2' are arranged one after the other when viewed in the direction of passing or running through of the rope or cable 4 (see FIG. 3). At least one of the cable drums 2 or 2' can be driven by the motor 3. The winch frame or support 1 is fixed in position by a holding means or mounting support 6 on a foundation or base 16.

The cable drums 2 and 2' have tracks or guide grooves 5 in their circumferential surfaces for guidance of the cable 4. The cable 4, which is under load, enters the continuous winch at a location A accompanied by engagement against a guide roller 7; the cable 4 winds several times around the cable drums, and leaves the winch frame at the exit location B in a non-loaded state.

A rotatably mounted cable storage drum 9 is arranged adjacent to the exit location B on a supporting arm 8 which is fastened on the frame 1 of the continuous winch. The axis of rotation 11 of the drum 9 is perpendicular to the plane which passes through or is defined by the axes of the cable drums 2 and 2'. An inlet opening C for the cable 4 is provided near the axis of rotation 11 on that end face 10 of the drum 9 which faces away from the frame 1.

In that stretch located between the exit location B on the frame and the inlet opening C of the cable storage drum 9, the cable 4 is held in a guide 21 formed by a helical spring 12, the spiral coils or windings of which surround the cable 4. The portion of the cable disposed in the helical spring 12 is not illustrated in the drawings to facilitate illustration of the features of the present invention. Each end of the helical spring 12 is held in a tubular piece 13, 14, one of which, in the region of the inlet opening C, is located on the stationary holding means or mounting support of the cable storage drum 9, and the other of which is located on the winch frame in the region of the exit location B. Preferably, the ends of the helical spring 12 are fixed by screws 15 radially inserted into the tubular pieces 13, 14.

Since the helical spring 12 has radially open portions 17 over its periphery, the dirt wiped or stripped off from the cable 4 which passes therethrough can drop between the spring coils or windings, so that an obstructing or clogging of the guide spring 12 by dirt is avoided. Because of the spring effect, there is additionally achieved that as the cable 4 passes through, the spring necessarily starts to vibrate, as a result of which an additional cleaning effect is attained. The "shaking" and "beating" of the spring against the cable 4 permits the adhering dirt to drop therefrom, so that the cable 4 enters the cable storage drum 9 substantially free of dirt, and a sticking together of the cable in the drum 9 is avoided.

The utilization of a helical spring 12 as a guide additionally assures a very simple assembly, since the spring can be easily adapted to any curve. This is in sharp contrast to the stiff tube of the prior art, where adaptation to curves is only possible with considerable production costs.

In one advantageous embodiment according to the present invention, the exit angle $\alpha_1$ is approximately 15°, while the inlet angle $\alpha_2$ of the cable 4 into the cable storage drum 9 is approximately 30°. For this purpose, the tubular pieces 13 and 14 are respectively fastened on the cable storage drum 9 and on the winch frame 1 in such a way that their axes 18 or 19 form the respectively desired angle $\alpha_1$ or $\alpha_2$ with the horizontal. It has been shown that with an inlet angle $\alpha_2$ of approximately 30°, an especially spacesaving or compact storage of the cable 4 in the cable storage drum 9 is possible.

It can be advantageous to not arrange the cable storage drum 9 on the continuous winch 1, but rather at a different location, for instance on a base or foundation 16. In such a situation, the arrangement of the tubular pieces 13 and 14 proves especially advantageous, since a constant inlet angle or discharge angle $\alpha_1$ or $\alpha_2$ always assured by the angularly accurate fixation thereof, independently of the diameter of curvature of the guide 21. This is true even when the cable storage drum 9 is arranged in such a way that its axis of rotation 11 lies approximately parallel to the axes of the cable drums 2 and 2' located in the winch frame.

The apertures of the inlet opening C and of the outlet opening B are advantageously directed in the same direction, so that the guide essentially has the shape of part of a circle.

The present invention is, of course, in no way restricted to the specific disclosure of the specification and drawings, but also encompasses any modifications within the scope of the appended claims.

What I claim is:

1. A continuous cable winch, including a winch frame, said winch comprising:

at least one cable drum arranged within said winch frame for receiving cable under load;

a cable storage drum located externally of said winch frame for receiving a non-loaded cable section from said at least one cable drum; and a flexible guide located in the region between said winch frame and said cable storage drum; said guide having coils with coil spacing including radially open portions over its periphery and entire length thereof to permit dirt stripped from the cable to discharge laterally therefrom, and having two ends, one of which is secured to said winch frame, and the other of which is secured to said cable storage drum; in a location remote from said winch frame said guide being adapted to receive said non-loaded cable section therein with play from said at least one cable drum and guide same to said cable storage drum, and mounting means securing said ends of the flexible guide to the winch frame and cable storage drum whereby the guide forms a substantially semi-circular loop to facilitate vibration of said flexible guide causing a cleaning effect to occur as to dirt loosened from the cable and allowed to drop out of said guide via said radially open portions.

2. A continuous winch according to claim 1, in which said guide comprises a helical spring, the coils of which are spaced from one another to form said radially open portions.

3. A continuous winch according to claim 2, wherein said mounting means includes an exit guide-piece arranged on said winch frame in such a way as to effect exit of said cable from said frame at an exit angle of approximately 15°.

4. A continuous winch according to claim 3, wherein said mounting means includes an inlet guide-piece arranged on said cable storage drum in such a way as to effect entry of said cable into said cable storage drum at an entry angle of approximately 30°.

5. A continuous winch according to claim 4, in which said exit guide-piece effects securing of said one end of said guide to said frame, and said inlet guide-piece effects securing of said other end of said guide to said cable storage drum.

6. A continuous winch according to claim 5, in which said winch frame includes a supporting arm, and in which said cable storage drum is mounted on said supporting arm.

7. A continuous winch according to claim 6, which includes two cable drums mounted in said winch frame in such a way that their axes of rotation lie in a common plane; and in which the axis of rotation of said cable storage drum is approximately perpendicular to said common plane.

* * * * *